US008960068B2

(12) United States Patent
Jacquemont et al.

(10) Patent No.: US 8,960,068 B2
(45) Date of Patent: Feb. 24, 2015

(54) FLOOR PROTECTION DEVICE FOR VEHICLE CAB

(75) Inventors: Jacky Jacquemont, Igny (FR); Christian Noel, Asnières sur Seine (FR); Xavier Poirmeur, Guyancourt (FR); Benoit Bettencourt, Chaville (FR)

(73) Assignee: Nexter Systems, Roanne (FR)

( * ) Notice: Subject to any disclaimer, the term of this patent is extended or adjusted under 35 U.S.C. 154(b) by 489 days.

(21) Appl. No.: 12/737,096

(22) PCT Filed: Jun. 10, 2009

(86) PCT No.: PCT/FR2009/000684

§ 371 (c)(1), (2), (4) Date: Dec. 8, 2010

(87) PCT Pub. No.: WO2009/153442

PCT Pub. Date: Dec. 23, 2009

(65) Prior Publication Data

US 2011/0079134 A1 Apr. 7, 2011

(30) Foreign Application Priority Data

Jun. 12, 2008 (FR) ..... 08 03278

(51) Int. Cl.
*F41H 7/04* (2006.01)

(52) U.S. Cl.
CPC ..... *F41H 7/042* (2013.01)
USPC ..... 89/36.02; 89/36.09; 296/187.07

(58) Field of Classification Search
USPC ..... 296/187.07, 187.08; 89/36.07, 36.08, 89/36.09, 903, 930
See application file for complete search history.

(56) References Cited

U.S. PATENT DOCUMENTS

| | | | | |
|---|---|---|---|---|
| 2,271,310 | A | 1/1942 | Schafer | |
| 3,073,647 | A | 1/1963 | Beltz | |
| 3,604,374 | A | 9/1971 | Matson et al. | |
| 4,090,734 | A | 5/1978 | Inami et al. | |
| 4,730,870 | A | 3/1988 | DeRees | |
| 5,435,619 | A | 7/1995 | Nakae et al. | |
| 5,533,781 | A | 7/1996 | Williams | |
| 5,663,520 | A * | 9/1997 | Ladika et al. | 296/187.07 |
| 5,746,537 | A | 5/1998 | Kellas et al. | |
| 5,905,225 | A | 5/1999 | Joynt | |
| 5,997,077 | A | 12/1999 | Siebels et al. | |
| 6,149,226 | A * | 11/2000 | Hoelzel et al. | 296/181.1 |
| 6,477,934 | B1 * | 11/2002 | Bruhn et al. | 296/193.07 |
| 2008/0034953 | A1 * | 2/2008 | Barbe et al. | 89/36.01 |
| 2008/0111396 | A1 | 5/2008 | Barbe et al. | |

FOREIGN PATENT DOCUMENTS

| | | | |
|---|---|---|---|
| CA | 2568803 | A1 | 12/2005 |
| CH | 666958 | A5 | 8/1988 |

(Continued)

*Primary Examiner* — Glenn Dayoan
*Assistant Examiner* — Melissa A Black
(74) *Attorney, Agent, or Firm* — Steptoe & Johnson LLP

(57) ABSTRACT

A protection device for a vehicle cab having a floor and two vertical side walls, the device including an armor plate below and substantially parallel to the floor of the cab, and deformable compartmented caissons connected between the floor and the armor plate and under the side walls of the cab, each compartmented caisson having buckleable walls dimensioned to buckle upon shock impact to the exterior of the armor plate.

19 Claims, 3 Drawing Sheets

(56) References Cited

FOREIGN PATENT DOCUMENTS

| | | | |
|---|---|---|---|
| DE | 3109976 | A1 | 1/1982 |
| DE | 8908112 | U1 | 8/1989 |
| DE | 9218388 | U1 | 2/1994 |
| DE | 19643757 | A1 | 4/1997 |
| DE | 197 35 594 | | 2/1999 |
| DE | 19735594 | A1 | 2/1999 |
| DE | 19738833 | A1 | 3/1999 |
| DE | 19740103 | A1 | 3/1999 |
| DE | 199 13 845 | | 9/2000 |
| DE | 19913845 | A1 | 9/2000 |
| DE | 199 35 573 | | 2/2001 |
| DE | 19935573 | A1 | 2/2001 |
| DE | 10045685 | A1 | 4/2002 |
| DE | 19941928 | | 10/2002 |
| DE | 10250132 | A1 | 5/2004 |
| DE | 10355913 | A1 | 7/2005 |
| DE | 202004015490 | U1 | 5/2006 |
| EP | 0001177 | A1 | 3/1979 |
| EP | 0235091 | A2 | 9/1987 |
| EP | 0 828 134 | | 3/1998 |
| EP | 0828134 | A2 | 3/1998 |
| EP | 0897097 | | 2/1999 |
| EP | 0899168 | A2 | 3/1999 |
| EP | 0963903 | A2 | 12/1999 |
| EP | 1607272 | A1 | 12/2005 |
| EP | 1607655 | A1 | 12/2005 |
| EP | 1740902 | A2 | 1/2007 |
| EP | 1754949 | A1 * | 2/2007 |
| EP | 1 921 416 | | 5/2008 |
| EP | 1921416 | A1 | 5/2008 |
| FR | 2903179 | A1 | 1/2008 |
| GB | 2071829 | A | 9/1981 |
| WO | WO 01/81853 | A1 | 1/2001 |
| WO | WO 2007/020531 | A1 | 2/2007 |

* cited by examiner

FLOOR PROTECTION DEVICE FOR VEHICLE CAB

This application is a national state entry of International Application No. PCT/FR2009/000684, filed Jun. 10, 2009 designating the U.S., which claims the benefit of French Application No. 08.03278, filed Jun. 12, 2008.

TECHNICAL FIELD OF THE INVENTION

The technical scope of the invention is that of floor protection devices for a vehicle cab and namely the floor of a military vehicle.

TECHNICAL BACKGROUND OF THE INVENTION

It is known to ensure the protection of a vehicle floor by placing an armour plate at a distance from this floor, such plate being fastened to the cab by deformable linking means such as flexible mounts. Patent DE19913845 discloses such a protection device.

The aim is to absorb part of the blast effect of the mine through the deformation of the armour plate whilst leaving a free space enabling the plate to deform without impacting the floor. The deformable linking means also absorb part of the energy of the shock.

However, the device described by this patent does not provide sufficient protection for the vehicle floor. The energy absorption capacities of the linking means are, in fact, insufficient. Furthermore, the solutions described by DE19913845 do not enable the free space located under the vehicle to be used to house equipment or components of the vehicle itself.

Patent DE19935573 discloses a protection device analogous to that proposed by DE19913845. This device comprises a deformable plate positioned under the vehicle floor to which is it connected by longitudinal beams with a layer of shock absorbing material being positioned between the beams and the vehicle. The protection capacities of such a device are also insufficient. Furthermore, the deformable plate is provided with mobility means that may be projected by the shock against the vehicle floor, and the beams are directly into contact with the floor supports and thus communicate the shock received directly to them.

DISCLOSURE OF THE INVENTION

The aim of the invention is to propose a device that firstly provides reinforced protection with a minimal mass for a vehicle floor, and secondly enables the free space under the vehicle floor to be used without deteriorating the protection efficiency.

Thus, the invention relates to a floor protection device for a vehicle cab, device comprising at least one armour plate that is arranged at a distance from the cab floor and which is connected to the latter by deformable linking means, device wherein at least one of the deformable linking means is constituted by a compartmented caisson, that is fastened to the cab on a substantially vertical lateral partition of the latter, the compartmented caisson comprising at least two walls that are substantially perpendicular to the armour plate and which are integral firstly with a lower wall on which the armour plate presses and secondly with an upper wall which presses on the cab, the walls having dimensions such that they buckle on impact.

According to a particular embodiment, the walls will be substantially perpendicular to a lateral partition.

The protection device may comprise at least two caissons integral with a same lower wall, the caissons being positioned at a distance from one another and separated by a space.

Advantageously, the caissons are further fastened to a same lateral plate, the caissons, the lateral plate and the lower wall thus forming a chamber.

The lateral plate may incorporate at least one opening giving access to the space separating the compartmented caissons.

The opening may be blocked by a hatch or cover, the space thus forming a storage case.

The floor protection device may comprise at least three caissons delimiting two spaces.

According to a particular embodiment, the lateral plate may form an angle with respect to the armour plate.

The chamber may furthermore be positioned such that it incorporates a plane upper rim which extends towards the outside of the vehicle beyond the lateral partition, such plane upper rim being parallel to or indistinguishable from the upper walls of the caissons.

According to a variant embodiment, at least one caisson is filled by an energy absorbing material.

DESCRIPTION OF THE DRAWINGS

The invention will become more apparent from the following description of different embodiments, such description being made with reference to the appended drawings, in which.

DETAILED DESCRIPTION OF THE INVENTION

Figure 1:
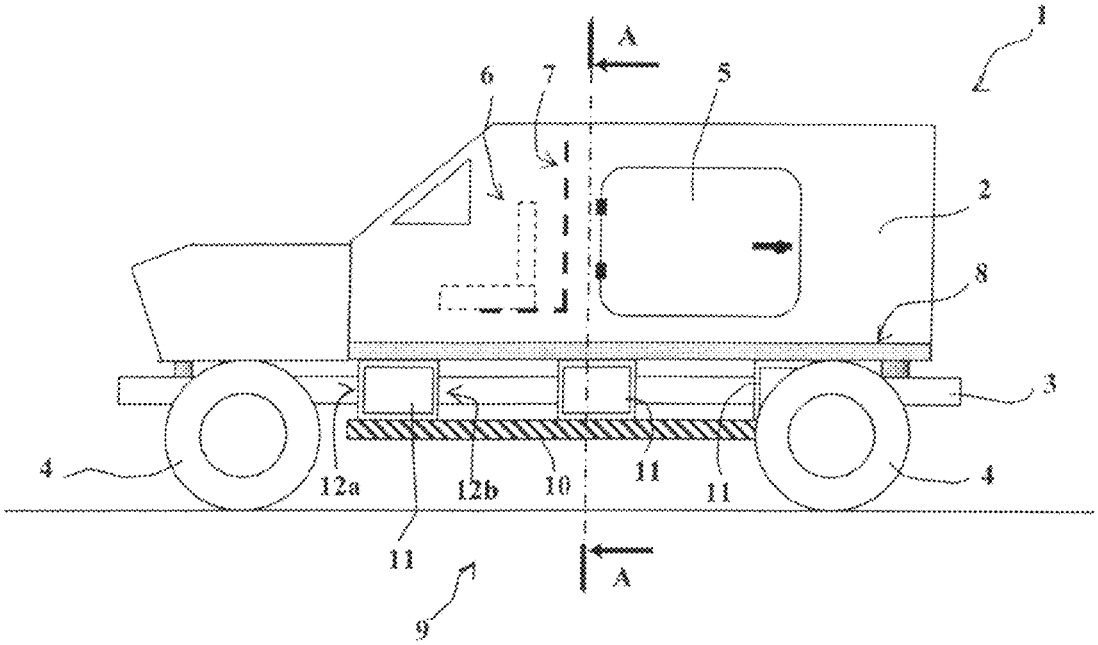
FIG. 1 is a side view of a light armoured vehicle equipped with a floor protection device according to a first embodiment of the invention.

With reference to FIG. 1, a light armoured vehicle 1 comprises a cab 2 fixed to a chassis 3 equipped with wheels 4. The inside of the cab can be accessed by a door 5 and it encloses seats 6 which are suspended from the cab roof by a support frame 7. Such an arrangement is classical and enables the seats to be isolated from the cab floor 8, thereby protecting the crew from the effects on the floor further to a mine exploding.

In accordance with the invention, a floor protection device 9 is provided that comprises an armour plate 10 (for example, of steel) that is positioned at a distance from the cab floor 8.

The plate 10, is fastened to the cab 2 by means of deformable linking means 11. In accordance with the invention, at least one of the deformable linking means 11 (and preferably all the linking means 11) is constituted by a compartmented caisson. FIGS. 1 and 2*a* show that the armour plate 10 is fastened by three caissons 11 arranged on each side of the vehicle.

As may be seen more particularly in FIG. 2*a*, the caissons 11 are arranged under a lateral partition 2*a* or 2*b* of the cab 2, such partition being substantially vertical. Thus, the loads received by the armour plate 10 will be communicated to the cab, not to the floor 8, but to the walls 2*a*, 2*b* that cannot be deformed so much.

Figure 2B:
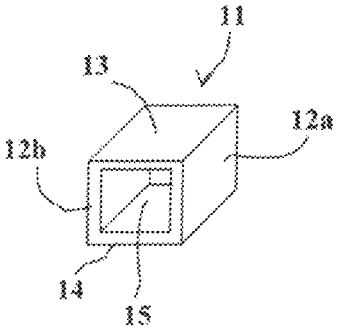
FIG. 2*b* is a perspective view of the caisson alone.
Figure 2A:
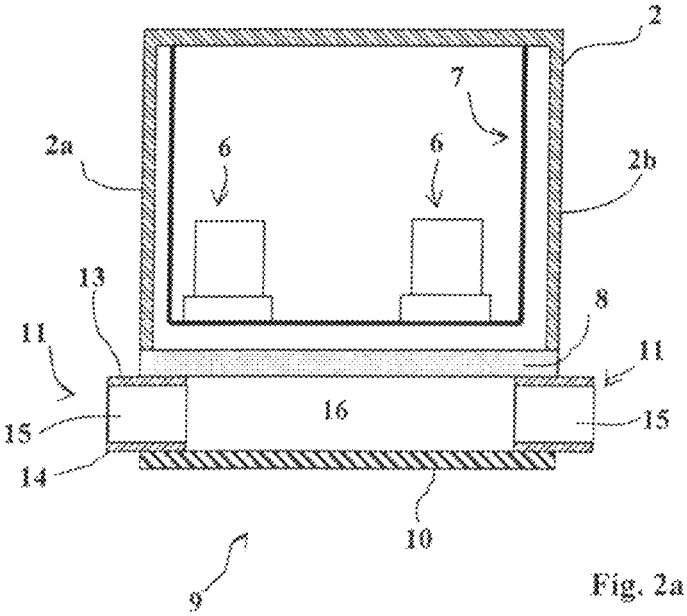
FIG. 2*a* is a cross section view of the previous Figure along the plane referenced AA in FIG. 1.

FIG. 2*b* shows a perspective view of a caisson 11 according to this first embodiment of the invention.

By compartmented caisson, we mean a substantially parallelepipedic structure that incorporates at least two walls 12*a*, 12*b* that will be arranged substantially perpendicularly to the armour plate 10. The walls 12*a*, 12*b* are integral with a lower wall 14 on which the armour plate 10 presses. The walls 12*a*, 12*b* are furthermore integral with an upper wall 13 that presses on the cab 2 and enables the device to be fastened to the latter. Each caisson 11 delimits an inner space 15 which is open laterally at each end of the caisson.

The walls 12*a*, 12*b* are thus substantially vertical and are furthermore dimensioned such that they buckle as a result of a shock transmitted by the armour plate 10 due to the detonation of an explosive device. This dimensioning will be performed classically by calculation depending on the material of the walls 12*a*, 12*b* and the expected level of shock. The buckling will be all the greater in that the wall is high with respect to its section.

The walls 12*a*, 12*b* delimit the inner space 15 of the caisson, they are furthermore also substantially perpendicular to the wall 12*a*, 12*b* in question of the cab 2.

This orientation of the walls leads to their section being reduced thereby improving their deformation by buckling. Such a configuration is thus far from that of the longitudinal beams described by DE19935573. Indeed, the latter extend over the full length of the vehicle (thereby increasing the section of the vertical walls of the beams) and they are reduced in height. Such beams absorb little energy by deformation and communicate most of the shock received to the vehicle's structure.

The upper wall 13 will have drill holes enabling the caisson 11 to be fastened to the floor 8 or to the cab 2.

The lower wall 14 will additionally have drill holes enabling the armour plate 10 to be fastened to the caisson 11.

The caissons 11 are made of steel (depending on the level of protection required, they could also be made of another material, for example aluminium or a composite). The walls 12*a*, 12*b* ensure the rigidity of the caisson. When an explosive device or mine explodes under the vehicle 1, the armour plate 10 is deformed by the blast effect. The free space 16 between the plate 10 and the floor 8 allows such a deformation without the shock being transmitted to the floor 8.

The loads are communicated by the plate to the caissons 11, which retransmit them to the walls 2*a*, 2*b* of the cab. However, the walls 12*a*, 12*b* will also deform by buckling. This deformation will consume part of the energy received but will above all attenuate the violence of the shock. Indeed, the energy of the explosion will be transmitted for a less brief duration which will reduce the stresses received by the vehicle and will attenuate the destructive effects on the cab.

It is possible for the caissons 11 to be given different shapes.

Figure 3A:
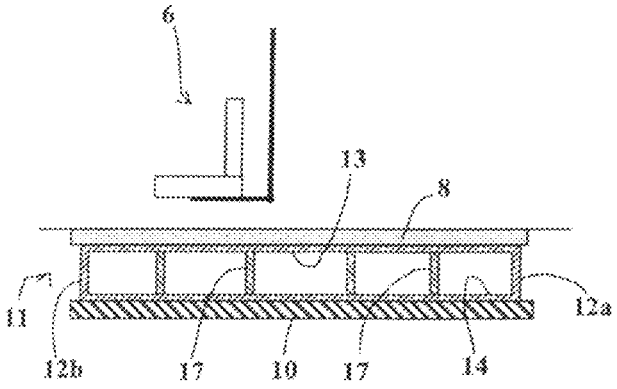
FIGS. 3*a* and 3*b* are partial views of a second embodiment of the invention, FIG. 3*b* being a perspective view of the chamber alone.
Figure 3B:
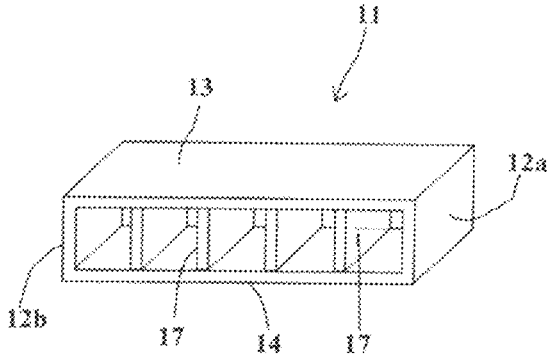

FIGS. 3*a* and 3*b* show another embodiment in which a single caisson 11 is positioned on either side of the vehicle but which has a length that is substantially equal to that of the armour plate 10.

To give the caisson 11 the properties of rigidity/deformability necessary for it to ensure its function of attenuating the shocks, partitions 17 parallel to walls 12*a*, 12*b* are arranged inside it (here there are four partitions). The partitions 17 will, for example, be welded to the upper 13 and lower 14 walls of the caisson.

Figure 4A:
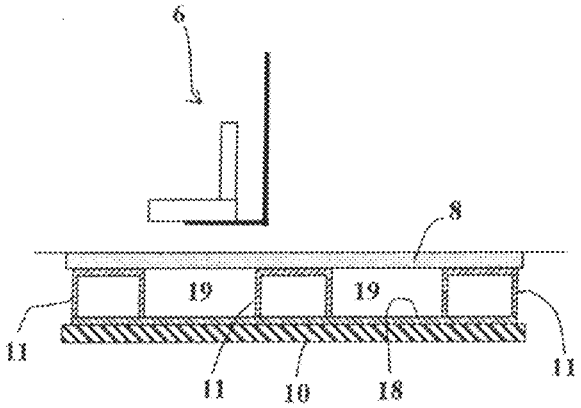
FIGS. 4*a* and 4*b* are partial views of a third embodiment of the invention, FIG. 4*b* being a perspective view of the chamber alone.
Figure 4B:
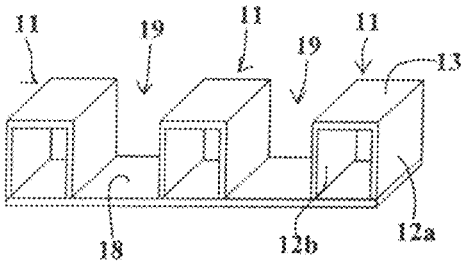

FIGS. 4*a* and 4*b* show another embodiment in which three caissons 11 are implemented, all integral with a same lower wall 18.

It is no longer necessary, in this case, to provide a specific lower wall 14 for each caisson 11. The lateral walls 12*a*, 12*b* and upper wall 13 thus form a U-shaped structure which will, for example, be welded to the common wall 18. When a mine is ignited, the shock received by the armour plate 10 will thus be transmitted to the wall 18 which will ensure the distribution of the shock over the different caissons 11.

With such an embodiment, the caissons 11 will be positioned at a distance from one another. Two neighbouring caissons 11 are thus separated by a space 19.

Advantage may be taken of these spaces 19 to constitute storage areas to be used by the vehicle's crew.

These spaces 19 may also house the organs of the vehicle, for example an exhaust silencer or batteries.

We note that it would also be possible in the embodiment shown in FIGS. 3*a*, 3*b* to use the spaces inside the caisson 11 (between partitions 17) by way of storage areas.

Figure 4C:
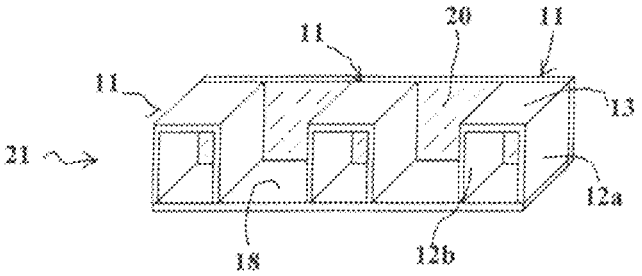
FIG. 4*c* is similar to FIG. 4*b*, and additionally includes lateral plate 20.

FIG. 4*c* differs from FIG. 4*b* in that the caissons 11 are also fixed to a same lateral plate 20 which here is perpendicular to the lower wall 18. The caissons 11, the lateral plate 20 and the lower wall 18 form a chamber 21.

The vehicle thus incorporates a chamber 21 on each side. Each chamber constitutes a compact assembly incorporating the caissons 11 to absorb the shock wave transmitted by the armour plate 10. The lateral plate 20 constitutes another deformable element that completes the caissons 11. It also enables the chamber to be closed thus insulating the inner spaces 19 from the exterior of the chamber. Openings will be advantageously provided in the lateral plate 20 which will carry closing covers to access the internal storage areas 19.

Figure 5:
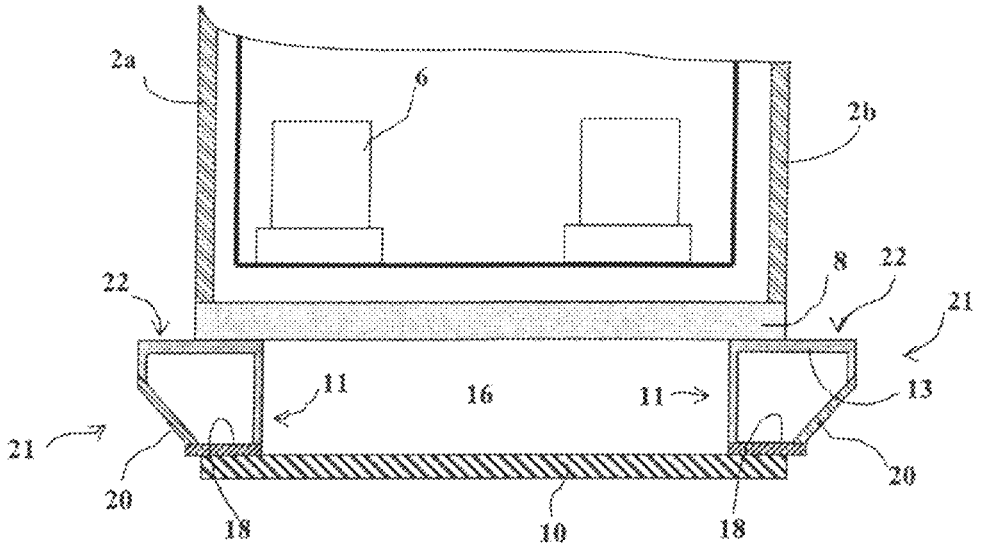
FIG. 5 is a cross section view of a light armoured vehicle equipped with a device according to a fourth embodiment of the invention.

FIG. 5 differs from the previous embodiment in that the caissons 11, grouped into chambers 21, incorporate a lateral plate 20 that forms an angle with respect to the armour plate 10.

Such an arrangement gives an overall deflector shape to the device 9, such shape ensuring a deviation of the blast received from a mine when the latter is in the vicinity of one of the rims of the armour plate 10.

Furthermore, FIG. 5 shows that each chamber 21 is positioned such that it incorporates a plane upper rim 22 that extends towards the outside of the vehicle beyond the lateral partition 2*a*, 2*b*.

This rim 22 is formed here of part of the upper wall 13. It constitutes a step to facilitate access to the vehicle.

Figure 6:
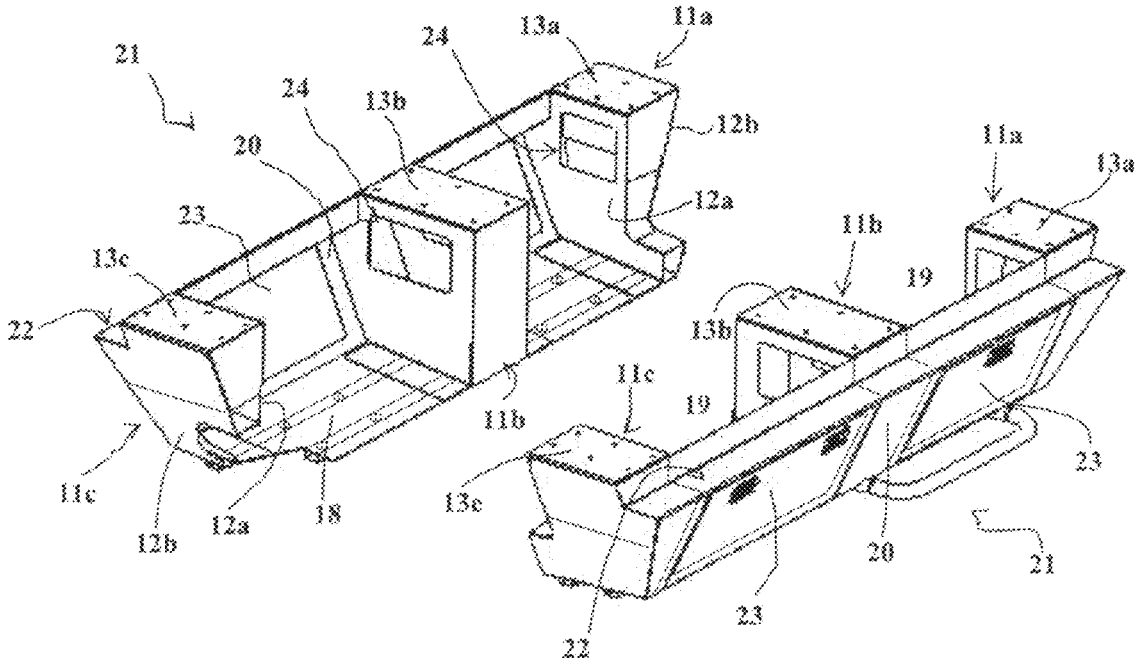
FIG. 6 is a perspective view of two chambers according to a fifth embodiment of the invention.

FIG. 6 shows another embodiment of the chambers 21 according to the invention. In accordance with this embodiment, the lateral plate 20 of each chamber is once again inclined with respect to the armour plate 10.

FIG. 6 shows that the lower wall 18 has two rows of holes to enable the armour plate (not shown in FIG. 6) to be fastened. Furthermore, the upper walls 13 (13*a*, 13*b* and 13*c*) of the caissons have holes to allow the passage of screws to fasten the device to the cab.

We note that in this embodiment, the caissons 11 are not all of the same shape. The end caissons 11*a* and 11*c* have lateral walls 12*a*, 12*b* that are not parallel. At least one wall (12*a*) is, however, still perpendicular to the lower wall 18 (and to the armour plate). The other wall 12*b* is slightly inclined with respect to the lower wall 18. Such an arrangement is intended to adapt the external shapes of the front 11*a* and rear 11*c* caissons (and thus of the chamber 21) to the structure of the vehicle. The walls 12*a* and 12*b* nevertheless ensure resistance to deformation for the caissons in question.

We note also on this Figure that the caissons 11 incorporate an opening 24 in certain of their lateral walls 12. These openings help to lighten the structure of the chambers and furthermore provide an access for the fastening screws enabling the upper faces 13 of the caissons to be joined to the vehicle cab.

This Figure shows that the lateral plates 20 incorporate openings giving access to the space 19 between the caissons 11. These openings are block by hatches 22 fitted with hinges and locks (not shown). FIG. 6 lastly shows that each chamber 21 here incorporates an upper rim 22 that completes the closing of the spaces 19. This rim 22 is parallel to the upper walls 13 of the caissons and is located on a plane slightly above the plane of the upper walls 13. The rim thus forms a step giving access to the vehicle cab.

In all of the embodiments previously described, the caissons 11 are empty. It is possible, by way of a variant, to put a deformable material inside one or several caissons able to complete the absorption of the impact energy. For example, deformable foam, for example metallic foam (such as aluminum foam) may be placed in the caissons. Sand or else a metallic or composite material cell structure, like a honeycomb, may be put in the caissons 11. It is also possible to install a shock absorbing material between the armour plate 10 and the lower wall 14 and/or between the upper wall 13 and the floor of the cell 8.

The invention claimed is:

1. A protection device fixed to a vehicle cab, the vehicle cab comprising:

a substantially planar floor extending throughout the entire width of the cab, and two substantially vertical lateral walls one on each side of the cab, wherein the protection device fixed to the cab, comprises:

at least one substantially planar armor plate extending throughout the entire width of the cab, arranged at a distance below the cab and substantially parallel to the floor of the cab, and first and second groups of at least one deformable compartmented caissons connected between the floor of the cab and the armor plate, wherein each compartmented caisson comprises at least two buckleable walls substantially perpendicular to the armor plate and dimensioned to buckle upon shock impact, and the caissons in each of said first and second groups each comprises at least one lower wall and one upper wall both integral with said buckleable walls, and said lower walls are fastened to the armor plate, and the upper walls are fastened to the floor of the cab, and said first and second groups are located with one of said groups below each side of the floor of the cab under said lateral walls of the cab, and a free space is defined between the floor and the armor plate and between said first and second groups.

2. A protection device according to claim 1, wherein said buckleable walls are substantially perpendicular to the lateral walls of the cab.

3. A protection device according to claim 1, wherein said first and second groups each comprises a plurality of compartmented caissons, wherein the compartmented caissons on each side of the cab are integral with the same lower wall of one group, wherein the compartmented caissons are positioned at a distance from one another so that the compartmented caissons are separated by at least one lateral space.

4. A protection device according to claim 3, wherein said first and second groups each comprises a lateral plate fastened to said compartmented caissons on each side of the cab.

5. A protection device according to claim 4, wherein said lateral plate has at least one opening thereby permitting access to said lateral space from the exterior of the vehicle.

6. A protection device according to claim 5, wherein said opening is closed by a hatch or a cover, said lateral space defining a storage case.

7. A protection device according to claim 5, wherein at least three of said compartmented caissons on each side of the cab define at least two of said lateral spaces.

8. A protection device according to claim 4, wherein said lateral plate forms an angle with respect to the armor plate such that the compartmented caissons on each side of the cab form a deflector.

9. A protection device according to claim 1, wherein at least one of said first and second groups on at least one side of the cab comprises a plane upper rim which extends outwardly from the vehicle beyond the lateral wall of the cab, said upper rim being parallel to said upper wall of said first or second group.

10. A protection device according to claim 1, wherein at least one of said compartment caissons is filled with an energy absorbing material.

11. A protection device according to claim 1, wherein at least one of said first and second groups comprises a plane upper rim which extends outwardly from the vehicle beyond the lateral wall of the cab, said upper rim corresponding to said upper wall of said first or second group.

12. A protection device according to claim 1, wherein each of said first and second groups comprises a plurality of upper walls and a plurality of lower walls, wherein each of said first and second groups comprises a plurality of compartmented caissons each comprising one of the upper walls and one of the lower walls independently from the other compartment caissons, wherein each of the lower walls is fastened to the armor plate, and each of the upper walls is fastened to the floor of the cab.

13. A protection device according to claim 1, wherein each of said first and second groups comprises a plurality of compartmented caissons.

14. A protection device according to claim 1, wherein each caisson of at least one of the first and second groups extends along the full length of the cab, on each side of the cab, each caisson further comprising partitions linked to said upper and lower walls of the first or second group.

15. A protection device according to claim 14, wherein in each caisson, said partitions are parallel to the buckleable walls.

16. A protection device according to claim 1, wherein said upper wall of said first group and said upper wall of said second group extend outwardly from the vehicle beyond the lateral wall of the cab to form a plane rim.

17. A protection device according to claim 16, wherein said first and second groups each comprises a lateral plate fastened to said compartmented caissons on each side of the cab, said lateral plate forming an angle with respect to the armor plate such that the compartmented caissons on each side of the cab form a deflector.

18. A protection device according to claim 17, wherein the armor plate is fastened to the cab by said deformable compartmented caissons.

19. A protection device according to claim 1, wherein the armor plate is fastened to the cab by said deformable compartmented caissons.

* * * * *